US005588822A

United States Patent [19]

Hayakawa et al.

[11] Patent Number: 5,588,822

[45] Date of Patent: Dec. 31, 1996

[54] FLAME TRAP FOR USE IN A PULSE COMBUSTOR

[75] Inventors: Tsuneyasu Hayakawa; Makoto Kimura, both of Aichi, Japan

[73] Assignee: Paloma Kogyo Kabushiki Kaisha, Nagoya, Japan

[21] Appl. No.: 424,808

[22] Filed: Apr. 19, 1995

[30] Foreign Application Priority Data

Jul. 1, 1994 [JP] Japan ..... 6-173750

[51] Int. Cl.[6] ..... F23C 11/04

[52] U.S. Cl. ..... 431/1; 431/346

[58] Field of Search ..... 431/1, 285, 346, 431/326, 328, 7, 350, 329; 60/39.77

[56] References Cited

U.S. PATENT DOCUMENTS 3,748,111 7/1973 Klose ..... 431/346

5,205,727 4/1993 Aoki et al. ..... 431/1

5,380,190 1/1995 Kumagai ..... 431/1

5,415,233 5/1995 Roussakis et al. ..... 431/346

FOREIGN PATENT DOCUMENTS 518639 11/1955 Canada ..... 431/285

*Primary Examiner*—James C. Yeung

*Attorney, Agent, or Firm*—Nikaido, Marmelstein, Murray & Oram LLP

[57] ABSTRACT

In a pulse combustor in which a mixture of air and fuel gas is supplied into a combustion chamber and subjected to pulse combustion, a flame trap is provided at the inlet of the combustion chamber to prevent back fires. The flame trap is formed as follows: A first tape of metal foil such as stainless steel foil is welded to one side of a second tape of metal foil, for instance, by blazing in such a manner that the first tape is corrugated, thus forming cells between them. Next, the first and second tapes thus welded together are spirally wound and combined with each other, for instance, by blazing.

2 Claims, 5 Drawing Sheets

FLAME TRAP FOR USE IN A PULSE COMBUSTOR

BACKGROUND OF THE INVENTION

This invention relates to a pulse combustor, and more particularly to an improvement in a flame trap which is provided at the inlet of a combustion chamber through which a mixture of air and fuel gas is supplied into the combustion chamber.

A pulse combustor is well known in the art in which a mixture of air and fuel gas is supplied to a combustion chamber, where it is subjected to an explosive combustion in a pulse mode.

FIG. 6 is a sectional view showing an complete pulse combustor, and FIG. 7 is an enlarged sectional view showing the essential components of the pulse combustor.

The pulse combustor 31 has a flame trap 34 between a combustion chamber 32 and a mixing chamber 33. In the mixing chamber 33, fuel gas introduced through a gas pipe 35 and a gas chamber 36 is mixed with air introduced through an air blower 37 and an air supply chamber 38. The mixture of air and fuel gas is supplied into the combustion chamber 32 through a number of vent holes 39 (hereinafter referred to as "cells 39", when applicable) formed in the flame trap 34. In the combustion chamber 32, the mixture is explosively burned into combustion gas. The combustion gas is sent to a tail pipe (not shown) through a discharge outlet 40 coupled to the combustion chamber 32. In this operation, a negative pressure is developed in the combustion chamber 32 so that a successive mixture of air and fuel gas is introduced into the combustion chamber 32 through the cells 39 formed in the flame trap 34, and is explosively burned by the return flame from the tail pipe (not shown).

The flame trap 34 of the pulse combustor is generally as shown in FIG. 8. That is, the flame trap 34 is made of a heat-resistant porous plate made of ceramic material. The flame trap 34 has a number of cells 41 arranged like the holes of a grating.

The flame trap made of a porous plate of ceramic material as shown in FIG. 8 has the following problems: In manufacturing the flame trap, it is not possible to reduce the thickness of the ceramic walls between the cells 41 beyond a prescribed limit. The purpose of the flame trap is not only to straighten the stream of the mixture flowing into the combustion chamber but also to prevent the flow of back fire from the combustion chamber toward the mixing chamber. Hence, each of the cells 41 should be small in aperture area. However, if the aperture area is made small the numerical aperture is unavoidably as required, then the numerical aperture is unavoidably decreased. Because of limitations involved in manufacturing is considerably difficult to make the numerical aperture higher than 70%.

Accordingly, during combustion, the flame trap is low in back-fire preventing ability, and the combustibility ($CO/CO_2$ ratio) is also low. Thus, the flame trap of this type adversely affects the performance of the pulse 10 combustor. This fact obstructs the high load combustion of the pulse combustor, and accordingly the miniaturization of the latter.

The flame trap of ceramic material is readily broken by shock. Hence, during assembly, the flame trap may be broken when struck by other components, or its fragments may clog up the vent holes. That is, the flame trap may be one of the factors which impedes the assembling work of the pulse combustor.

SUMMARY OF THE INVENTION

Accordingly, an object of the invention is to eliminate the above-described difficulties. More specifically, an object of the invention is to decrease the aperture area of each of the cells of the flame trap through which the mixture of fuel gas and air flows, and to increase the total numerical aperture of the flame trap, thereby to achieve high load pulse combustion. An additional object of the invention is to provide a flame trap which can be built in a pulse combustor with ease, thereby to provide a pulse compact in structure and high in combustion load.

The foregoing object of the present claimed invention has been achieved by the provision of a pulse combustor in which, according to the invention, a back fire preventing flame trap is provided at the inlet of a combustion chamber, into which of air and fuel gas is supplied, comprises:

a first tape of metal foil such as stainless steel foil;

a second tape of metal foil such as stainless steel foil which is welded to one side of the first tape in such a manner that the second tape is corrugated, thus forming cells between the first and second tapes; and the first and second tapes being spirally wound.

Preferably, in the pulse combustor, each of the cells in the flame trap is 2.25 $mm^2$ or less in aperture area, and the total numerical aperture of the flame trap is 75% or more.

In the present claimed invention the term "numerical aperture" is the percentage of the cross-sectional area of all of the holes to the cross-sectional area of the flame trap. The numerical aperture can be represented by the following equations:

$$\frac{\text{whole cross-sectional area of the holes}}{\text{cross-sectional area of the flame trap}} \times 100 = \text{numerical aperture } \% \quad (1)$$

or for holes of like size;

$$\frac{\text{cross-sectional area of a hole}}{\text{cross-sectional area of the flame trap}} \times \text{number of holes} \times 100 = \text{numerical aperture } \% \quad (2)$$

The numerical aperture may also be referred to as the effective aperture area opening or the cross-sectional air/fuel porosity of the flame trap.

In the pulse combustor of the present claimed invention, the mixture of air and fuel gas formed in the mixing chamber is supplied through the number of cells formed in the flame trap into the combustion chamber, where it is continuously subjected to explosive combustion. The flame trap interposed between the mixing chamber and the combustion chamber is formed by spirally winding the flame trap tape. The flame trap tape comprises a first tape of metal foil and a second tape of metal foil welded to one side of the first tape of metal foil in such a manner that the second tape of metal foil is corrugated, thus forming the cells between them. Hence, the aperture area of each of the cells is small, and the total numerical aperture is large. The mixture of air and fuel gas is supplied through the small cells formed in the flame trap into the combustion chamber, where it is subjected to explosive combustion. In this operation, since the aperture area of each cell is small as was described above, the flow of back fire toward the mixing chamber from the combustion chamber is prevented; and since the total numerical aperture is large, the mixture of air and fuel gas is increased in quantity. Thus, the combustibility ($CO/CO_2$ ratio) is improved, and the high load pulse combustion is continuously carried out.

In the pulse combustor of the present claimed invention, the aperture area of each of the cells of the flame trap can be set to 2.25 $mm^2$ or less, and the total numerical aperture of the flame trap can be set to 75% or more. This feature permits the pulse combustor to continue high load pulse combustion more effectively. That is, because the aperture area of each cell is made 2.25 $mm^2$ or less, the flow of back fire from the combustion chamber towards the mixing chamber is positively prevented; and because the total numerical aperture of the flame trap is made 75% or more, the mixture of air and fuel gas supplied from the mixing chamber into the combustion chamber is increased in quantity, so that high load pulse combustion is effected in the pulse combustor.

DETAILED DESCRIPTION OF THE PREFERRED EMBODIMENTS

The above and other objects. and the attendant advantages of the present invention will become readily apparent by reference to the following detailed description when considered in conjunction with the accompanying drawings.

A pulse combustor, which is a preferred embodiment of the invention, will be described with reference to the accompanying drawings.

Figure 7:
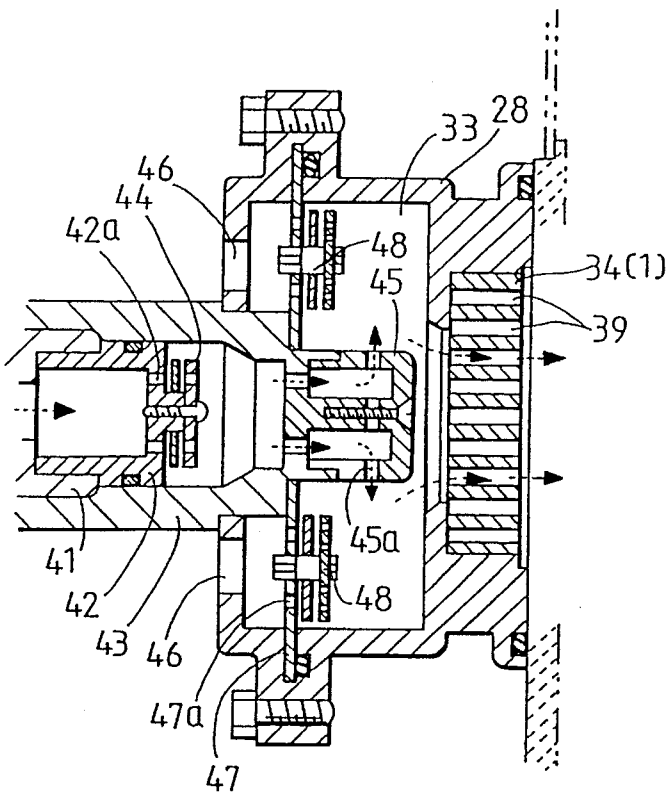
FIG. 7 PRIOR ART
FIG. 7 is a sectional view showing essential components (a flame trap and its relevant components) of the pulse combustor shown in FIG. 6.
Figure 6:
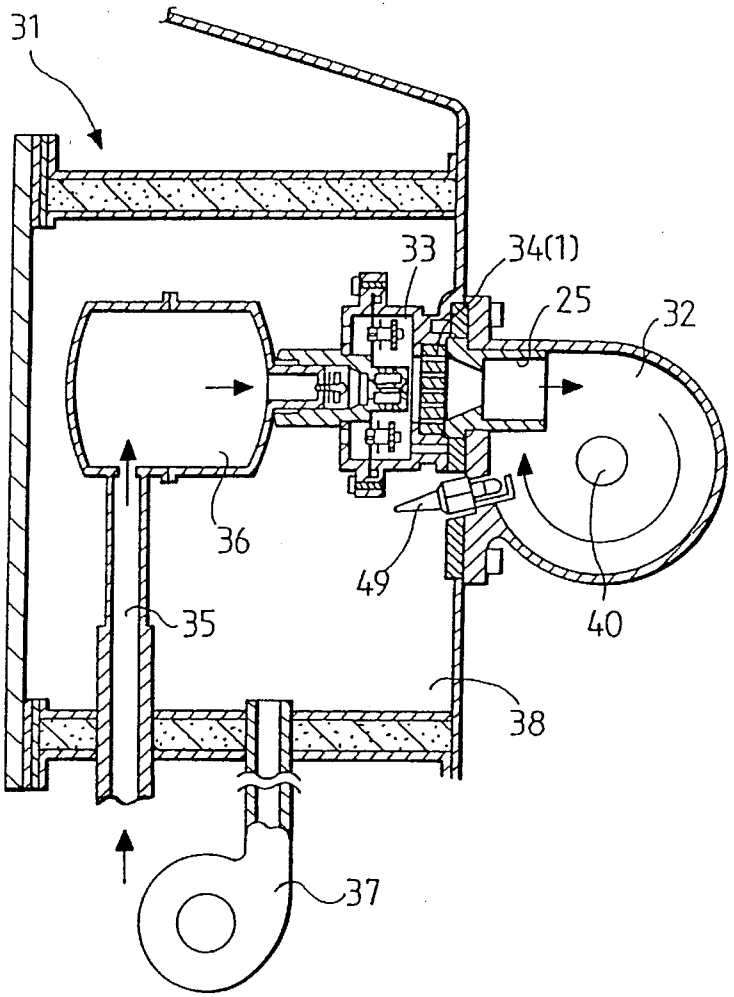
FIG. 6 PRIOR ART
FIG. 6 is a sectional view outlining the arrangement of a conventional pulse combustor.
Figure 8:
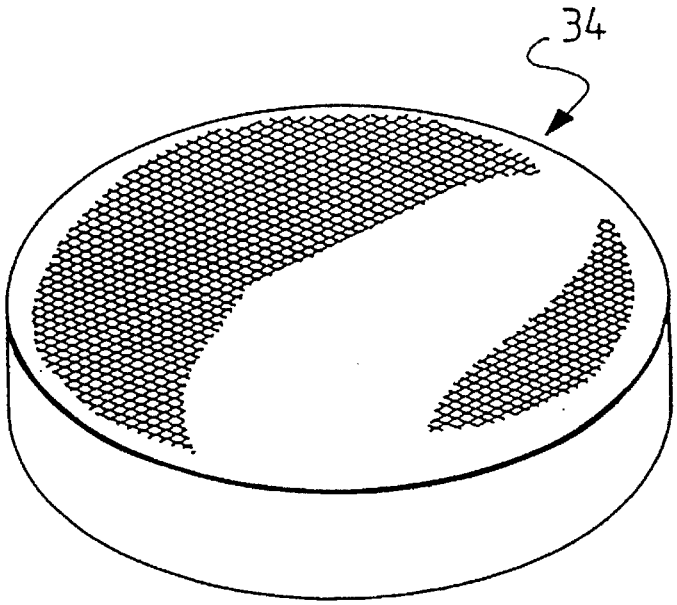
FIG. 8 PRIOR ART
FIG. 8 is a perspective view showing a typical example of the flame trap in the pulse combustor shown in FIGS. 6 and 7.
Figure 9:
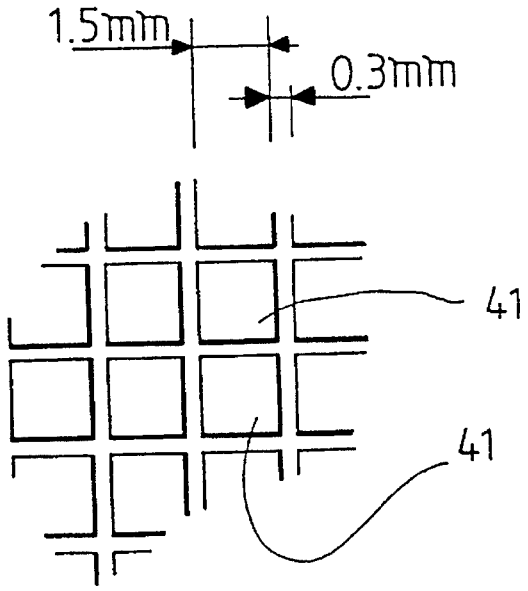
FIG. 9 PRIOR ART
FIG. 9 is an enlarged view showing a part of the flame trap shown in FIG. 8.

First the above-described pulse combustor will be further described with reference to FIG. 6 which is a sectional view showing a pulse combustor. FIG. 7 which is an enlarged sectional view showing essential components of the pulse combustor.

The pulse combustor 31 comprises: the air supply chamber 38 in the form of a box incorporating the gas chamber 36 and the mixing chamber 33; the air blower 37 for introducing air into the air supply chamber 38; and the combustion chamber 32 which is fixedly mounted on the outer wall of the air supply chamber 38 and communicated with the mixing chamber 33.

The gas chamber 36 is a closed container with a gas pipe 35 which is extended through the wall of the air supply chamber 38 so that the gas chamber 36 is communicated with outside.

On the other hand, as shown in FIG. 7 a nozzle pipe 42 is fixedly connected to the end portion of a gas introducing short pipe 41. The short pipe 41 together with the nozzle pipe 42 is fitted in a gas nozzle stand 43 in such a manner that the short pipe 41 and the nozzle pipe 42 are covered by the latter 43. The end portion of the gas nozzle pipe 43 is protruded into the mixing chamber 44. Vent holes **42*a* are formed in the end of the nozzle pipe 42, and a gas check valve 44 is provided at the end of the nozzle pipe 42 so that fuel gas passed through the vent holes 42*a*** may not return.

The end portion of the gas nozzle stand 43, which is located inside the mixing chamber 33, is connected to a gas distributor 45. The gas distributor 45 has vent holes **45*a* which extend in different directions so that fuel gas is diffused in the mixing chamber 33**.

In order to introduce the air which has been led in the air supply chamber 38, vent holes 46 are formed in the wall of the mixing chamber body 28 of the mixing chamber 33 in such a manner that they are arranged around the gas nozzle stand 43. Inside the mixing chamber 33, an air plate 47 is fixedly mounted in such a manner that it is in contact with the wall having the aforementioned vent holes 46. The air plate 47 has vent holes **47*a* small in diameter which are circularly arranged at equal intervals. An air check valve 48 is provided for each of the vent holes 47*a***.

On the other hand, the combustion chamber 32 communicated through the flame trap 1 with the mixing chamber has a circular hollow inside it. The combustion chamber 32 has an air-fuel mixture inlet 25 for introducing a mixture of air and fuel gas into the combustion chamber in the direction of a tangent to the circular hollow, and a discharge outlet 40 for discharging burnt gas from the combustion chamber in a direction perpendicular to the direction of introduction of the mixture of air and fuel gas. In order to prevent combustion flame from going into the air-fuel mixture inlet 25, the end portion of the latter 25 is slightly protruded into the combustion chamber 32.

Figure 1:
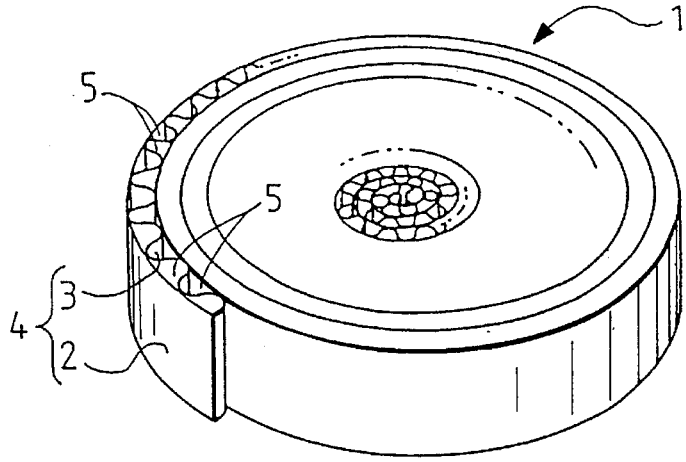
FIG. 1 is a perspective view showing a flame trap in a pulse combustor which constitutes one preferred embodiment of the invention.
Figure 2:
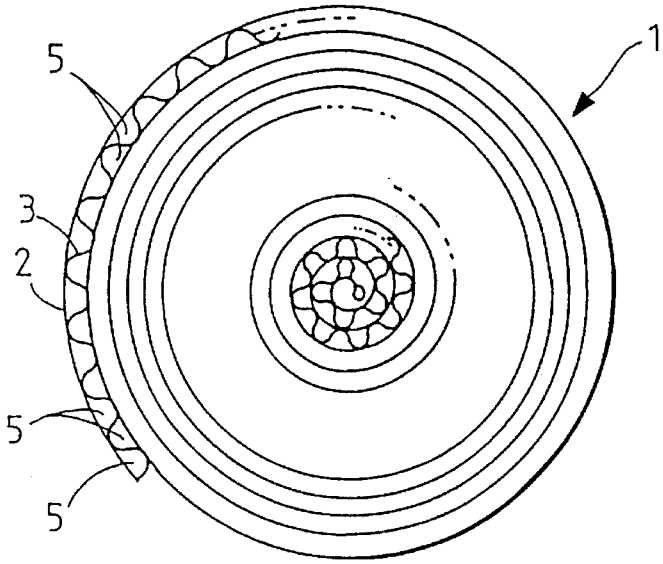
FIG. 2 is a plan view of the flame trap shown in FIG. 1.
Figure 3:
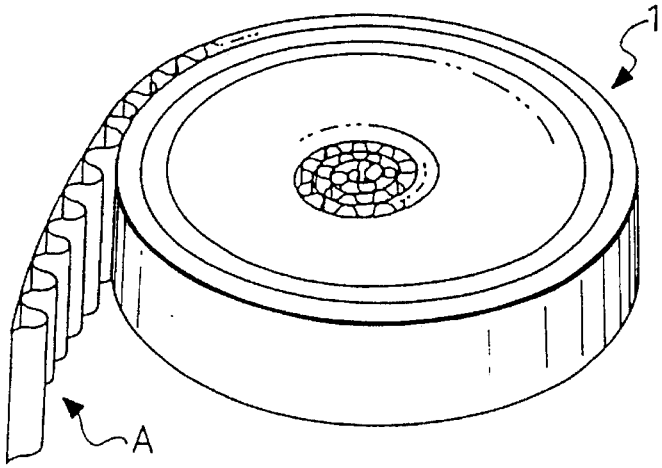
FIG. 3 is a perspective view for a description of a method of forming the flame trap.

Now, the flame trap, a specific feature of the invention, will be described with respect to FIGS. 1, 2 and 3. FIG. 1 is a perspective view of the flame trap, FIG. 2 is a plan view of the flame trap, and FIG. 3 is a perspective view showing the flame trap which is being formed.

The flame trap 1 is formed as follows: First, a base tape 2 is prepared which is a piece of belt-shaped stainless steel foil. A corrugated tape 3 is prepared which is also made of a piece of belt-shaped stainless steel foil. The corrugated tape 3 is welded to one side of the base tape 2, to form a flame trap tape 4 which is in the form of a belt having a wavy surface A on one side.

The flame trap tape 4 is 0.05 mm in thickness, and 13 mm in width. The flame trap tape 4 is spirally wound with the wavy surface A set inside. The flame trap tape 4 thus wound is brazed in a brazing oven, to form the aimed flame trap 1. The waveform of the wavy surface A is 2.2 mm in period and 1.3 mm in amplitude. The flame trap tape 4 is wound many turns until its outside diameter reaches 90 mm. As shown in FIG. 2, the flame trap 2 thus formed has a number of vent holes 5 (hereinafter referred to as "cells 5", when applicable) through which a mixture of air and fuel gas is allowed to flow.

Figure 4:
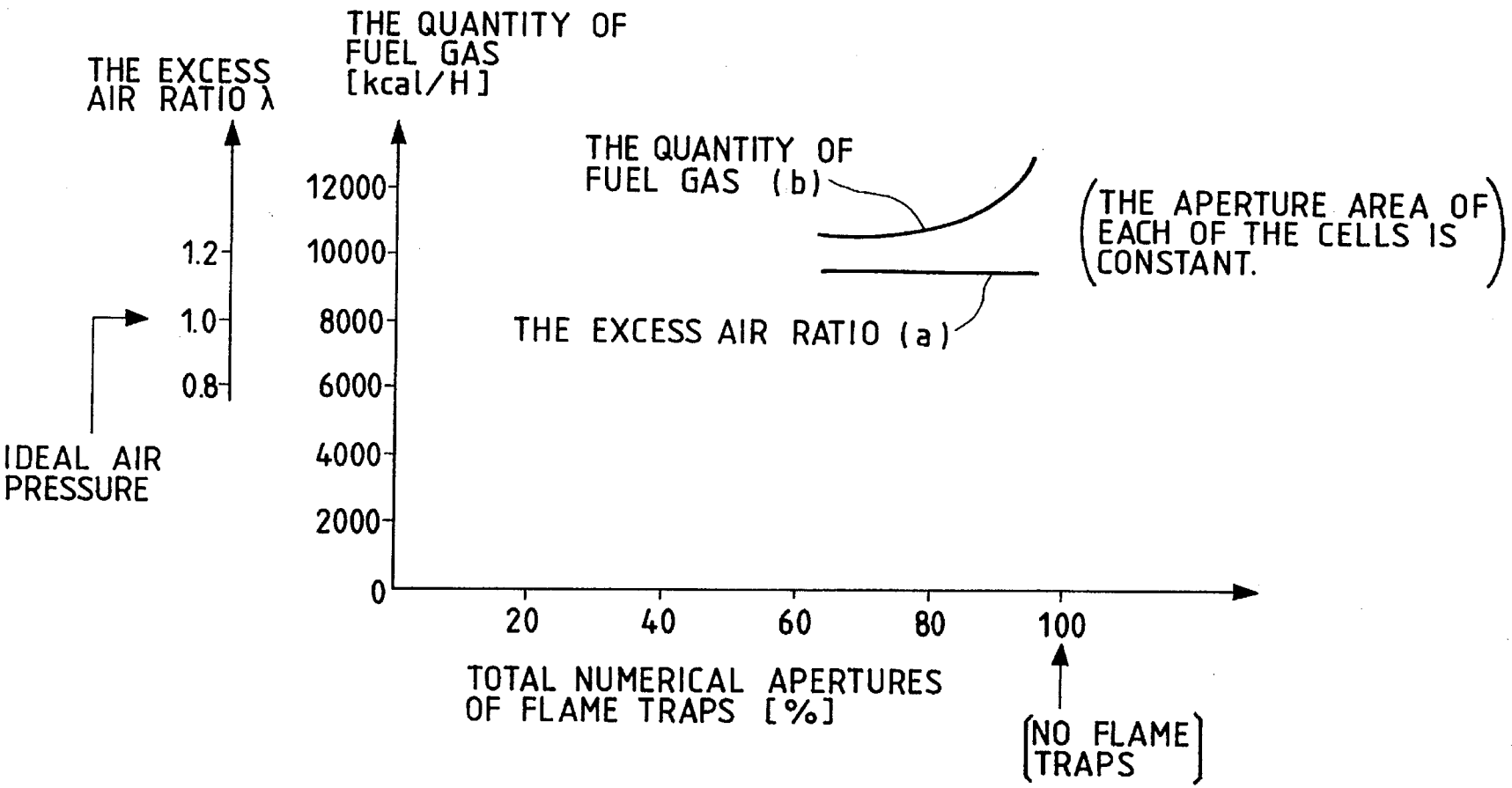
FIG. 4 is a graphical representation for a description of the effect of a numerical aperture of the flame trap on the efficiency of combustion of the pulse combustor, indicating total numerical apertures of flame traps with quantities of fuel gas supplied.
Figure 5:
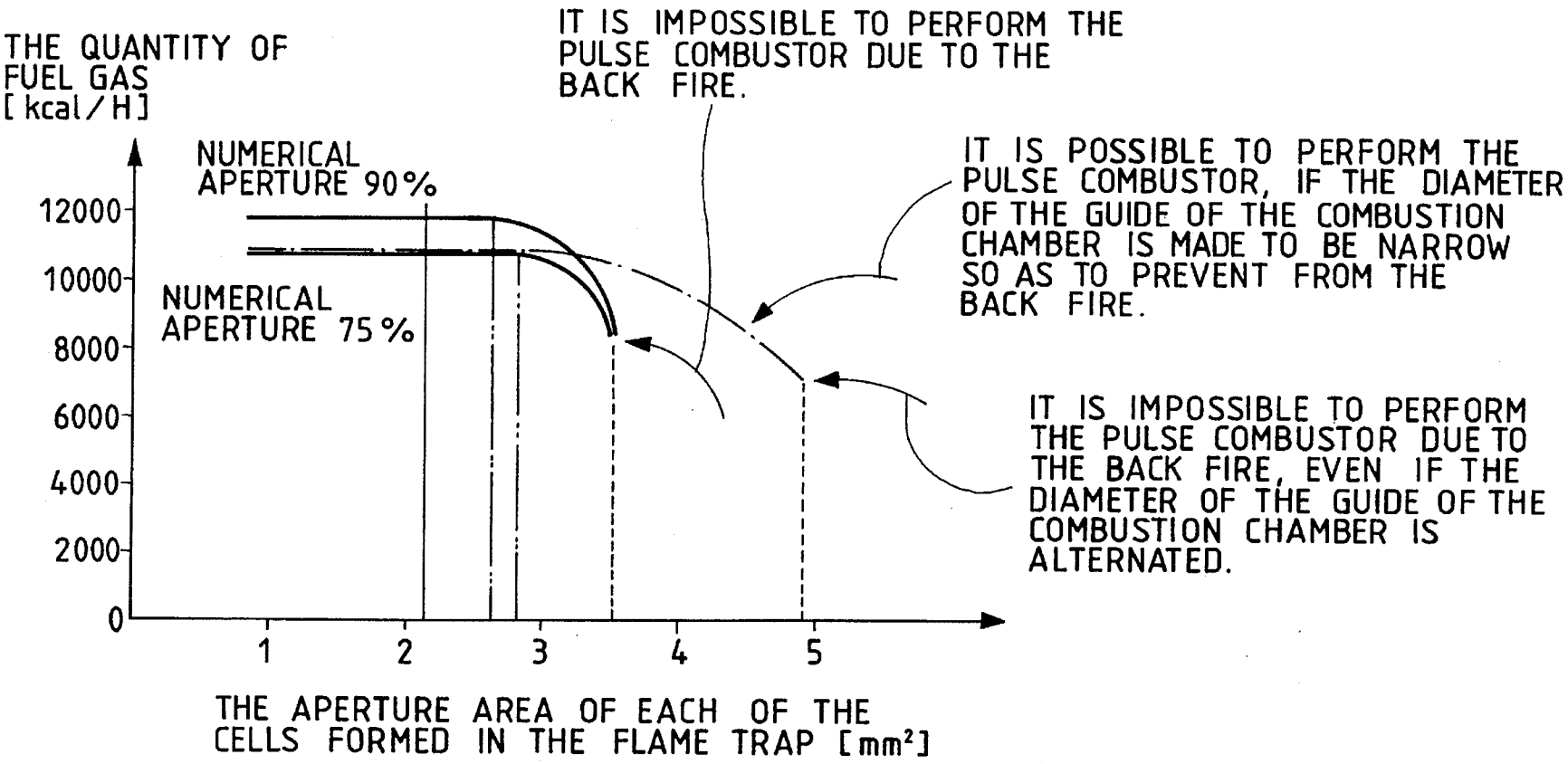
FIG. 5 is also a graphical representation for a description of the effect of the aperture area of each of the cells formed in the flame trap, indicating quantities of fuel gas supplied when the aperture area of each of the cells is varied.

For high load pulse combustion, the above-described numerical data of the flame trap 1 have been experimentally determined as follows: FIG. 4 is a graphical representation indicating the total numerical apertures of flame traps with quantities of fuel gas supplied. FIG. 5 is also a graphical representation indicating quantities of fuel gas supplied when the aperture area of each cell is varied.

As is seen from FIG. 4, when the mixture was supplied from the mixing chamber 33 into the combustion chamber 33 while the numerical aperture being increased, as indicated by the curve (a) the excess air ratio was constant independently of the numerical aperture; whereas as indicated by the curve (b) the quantity of fuel gas supplied was abruptly increased when the numerical aperture was about 75%.

From this and from the fact that high load pulse combustion needs a large quantity of fuel gas, it can be determined that the numerical aperture of the flame trap should be set to at least 75%.

According to the above-described result, experiments were carried out with the numerical aperture of the flame trap set to 75% and 90%. As shown in FIG. 5, in the case where the numerical aperture was set to 75%, the quantity of fuel gas supplied was decreased being affected by the back fire when the aperture area of each cell exceeded 2.8 $mm^2$; whereas in the case where the numerical aperture was set to 90%, the quantity of fuel gas supplied was decreased when the aperture area of each cell exceeded 2.6 $mm^2$.

From the results of the above-described experiments, it can be determined that, in order to supply a predetermined quantity of fuel gas stably (being not affected by the back fire) in the case where the numerical aperture of the flame trap is 75% or higher, the aperture area of each of the cells formed in the flame trap should be 2.25 $mm^2$ or less.

In summary, for high load pulse combustion, the flame trap should be so designed that the aperture area of each of the cells is 2.25 $mm^2$ or less and the numerical aperture is 75% or more.

The pulse combustor thus constructed operates as follows

First, fuel gas is supplied through the gas pipe 35 into the gas chamber 36, where it is made uniform in pressure. The fuel gas thus processed is supplied through the vent holes 42*a* of the nozzle pipe 42 fitted in the gas nozzle stand 43 and through the vent holes 45*a* of the gas distributor 45 into the mixing chamber 33. In this operation, in the mixing chamber 33, the fuel gas is run in many directions because of the vent holes 45*a* of the gas distributor 45.

On the other hand, air is led in the air supply chamber 38 by the air blower 37, where it is made uniform in pressure. The air thus processed is supplied through the vent holes 46 into the mixing chamber body 28. The air thus supplied in the mixing chamber body 28 is moved through the vent holes 47*a* of the air plate 47 into the mixing chamber 33. As a result, in the mixing chamber 33, the air and the fuel gas are mixed to form an air-fuel mixture. The air-fuel mixture is supplied through the flame trap 1 and through the air-fuel mixture inlet 25 into the combustion chamber 32.

In the initial period of combustion, the air-fuel mixture is explosively burnt being forcibly supplied into the combustion chamber and forcibly ignited by a plug 49. Thereafter, the air blower 37 is stopped, so that the resultant negative pressure acts to automatically suck in the mixture and the discharge heat automatically ignites it. Hence, a cycle of suction, explosive combustion, expansion and discharge is automatically repeated at a rate of 80 to 100 times per second. The burnt gas is discharged from the combustion chamber 33 through the discharge outlet 40 every cycle.

In this embodiment, a large quantity of air-fuel mixture which is made uniform in pressure in chamber 33 is supplied from the mixing chamber 33 into the combustion chamber 32 as was described above. In this operation, the flow of the air-fuel mixture is straightened when passing through the number of cells 5 formed uniformly is in the flame trap 1.

On the other hand, back fire is caused toward the mixing chamber by the burnt gas in the combustion chamber. The burnt gas causing the back fire loses its motion toward the mixing chamber 33 while passing through the small cells 5 of the flame trap 1, each being 2.25 $mm^2$ in sectional area, which prevents the reduction in quantity of the air-fuel mixture which is to be supplied into the combustion chamber 32 next.

As is apparent from the above description, in the flame trap 1 of the invention, the sectional area of each of the cells is made small. This feature positively prevents the occurrence of back fire during combustion, and accordingly improves the combustibility ($CO/CO_2$ ratio) and the performance of the pulse combustor. Thus, the pulse combustor is able to achieve the high load combustion.

In the flame trap 1, each of the cells is made small in sectional area and the numerical aperture is made large. Hence, the flame trap 1 can be made compact, and accordingly the pulse combustor also can be made compact.

The flame trap of stainless steel is high in shock resistance. Hence, it will not be broken even if struck by other components during assembly, and accordingly the flame trap 1 is free from the difficulty that fragments of the broken flame traps clog up the vent holes. Thus, the problems have been solved which are heretofore involved in the work of setting the flame trap in the pulse combustor.

While there has been described in connection with the preferred embodiment of this invention, it will be obvious to those skilled in the art that various changes and modifications may be made therein without departing from the invention. For instance, the cells 5 of the flame trap which are sinusoidal in section may be modified into ones triangular or rectangular in section. All such changes and modifications fall within the true spirit and scope of the invention.

In the pulse combustor, the flame trap provided at the inlet of the combustion chamber into which a mixture of air and fuel gas is supplied is formed by spirally winding the flame trap tape which comprises the first tape of metal foil such as stainless steel foil and the second tape of the same material welded to one side of the first tape in such a manner that the second tape is corrugated, thus forming the cells between them. Hence, the aperture area of each of the cells of the flame trap is small, and the total numerical aperture of the latter is large. This feature permits the pulse combustor to effectively perform high load pulse combustion. Since the flame trap of the invention, unlike the conventional brittle one, is made of metal foil, it can be readily set in the pulse combustor. This means that the pulse combustor of the invention is improved in productivity.

On the other hand the sectional area of each cell in the flame trap is set to 2.25 $mm^2$ or less, and the total numerical aperture is set to 75% or more, which permits the pulse combustor to achieve high load pulse combustion effectively. This feature makes it possible to make flame trap and accordingly the pulse combustor compact.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A flame trap and pulse combustor combination in which a mixture of air and fuel gas is supplied into a combustion chamber and subjected to pulse combustion, said flame trap comprising:

a first metal foil tape;

a second metal foil tape that is welded to one side of said first metal foil tape in such a manner that said second metal foil tape is corrugated so as to define cells between said first and second metal tapes;

said first and second metal foil being spirally wound;

wherein each of said cells in said flame trap is 2.25 $mm^2$ or less in aperture area, and a total numerical aperture of said flame trap is 75% or more.

2. A flame trap and pulse combustor combination as claimed in claim 1, wherein said first and second metal foil tapes comprise stainless steel foil.

* * * * *